US005359816A

United States Patent [19]

Iacouides

[11] Patent Number: 5,359,816

[45] Date of Patent: Nov. 1, 1994

[54] BUILDINGS AND METHODS OF CONSTRUCTING BUILDINGS

[75] Inventor: Efthyuoulos Iacouides, Nicosia, Cyprus

[73] Assignee: Permahome (Steel Constructions) Ltd., Nicosia, Cyprus

[21] Appl. No.: 670,768

[22] Filed: Mar. 18, 1991

[30] Foreign Application Priority Data

Mar. 16, 1990 [GB] United Kingdom ..... 9005959.3

[51] Int. Cl.[5] ..... E02D 27/01; E04B 2/56

[52] U.S. Cl. ..... 52/274; 52/236.7; 52/241; 52/262; 52/265; 52/266; 52/275; 52/293.3; 52/772

[58] Field of Search ..... 52/274, 275, 284, 285, 52/286, 241, 403, 600, 601, 602, 282, 252, 234, 236.6, 285.1, 293.1, 293.2, 293.3, 477, 491, 282.1, 236.7, 262, 264, 265, 266, 772

[56] References Cited

U.S. PATENT DOCUMENTS

| | | | |
|---|---|---|---|
| 1,618,886 | 2/1927 | Peterson | 52/491 |
| 1,863,981 | 6/1932 | Groves | 52/274 |
| 2,153,672 | 11/1939 | Mills . | |
| 2,883,852 | 4/1959 | Midby | 52/274 |
| 3,258,888 | 5/1966 | Lum . | |
| 4,219,978 | 9/1980 | Brown | 52/125 |
| 4,222,208 | 9/1980 | Ferver | 52/169.5 |
| 4,328,651 | 5/1982 | Gutierrez | 52/239 |
| 4,653,239 | 3/1987 | Randa | 52/90 |
| 4,869,036 | 9/1989 | Peacock | 52/233 |

FOREIGN PATENT DOCUMENTS

| | | |
|---|---|---|
| 0039614 | 11/1981 | European Pat. Off. . |
| 0320745 | 6/1989 | European Pat. Off. . |
| 2122372 | 9/1972 | France . |
| 2266440 | 10/1975 | France . |
| 2500038 | 8/1982 | France . |

*Primary Examiner*—Michael Safavi
*Attorney, Agent, or Firm*—Bacon & Thomas

[57] ABSTRACT

A building (1) or other walled structure has a foundation (6) formed of concrete or the like, a substantially rigid load bearing space frame (2) comprising a plurality of beams (4) and columns (3) secured to the foundation, and lightweight wall panels (5) extending between the columns. The lower edges of the wall panels are located and supported by elongate inserts (12) e.g. angle irons, in channels (11) formed in the foundation, and the upper edges are engaged in downwardly facing channels formed in the beams. In upper stories, the lower edges of wall panels are engaged in upwardly facing channels also formed in the beams.

9 Claims, 5 Drawing Sheets

BUILDINGS AND METHODS OF CONSTRUCTING BUILDINGS

This invention relates generally to buildings and methods of their construction and assembly and is particularly concerned with prefabricated buildings.

In some areas the design and construction of traditional buildings with local materials and by a local workforce can be time consuming, expensive and lead to unsatisfactory results, particularly if the local materials are not suitable or the workforce is unskilled. Prefabricated buildings are available which are designed and manufactured centrally in the convenience of a factory and only require delivery to or assembly by a local workforce. For example, prefabricated wall panels can be constructed accurately at a factory, rather than being built up at the building site. However, known prefabricated buildings do not tend to be easily adapted to suit differing uses and conditions and are frequently aesthetically unappealing.

Viewed from one aspect, the present invention provides a building comprising a foundation, a load bearing frame and wall panels, wherein the bottom of each wall panel is located by an elongate rigid insert in said foundation, having horizontally and vertically extending flanges.

Thus, the inserts define the location of the walls so that once the inserts have been positioned the walls can subsequently be erected simply and easily without requiring a high degree of skill. Furthermore, the wall panels need not be load bearing so that their construction is not critical to safety. In preferred embodiments very deep foundations are not required and the building can therefore be constructed on almost any terrain. The building is preferably adapted to be constructed rapidly and at a low cost with a minimum of specialised and heavy equipment and by a relatively small and unskilled workforce.

At least some and preferably substantially all of the components are preformed, that is they are manufactured remote from the eventual site of erection of the building where there are suitable facilities for manufacturing low cost, high quality components. The preformed components can then be easily transported to the site in a dismantled and ready to assemble condition. Of course, components could be constructed in temporary facilities near the site of erection, rather than at a factory.

The inserts are preferably provided in upwardly facing channels formed in a foundation slab, the lower edges of the wall panels then being received within these upwardly facing channels. In general a material such as unset concrete will be laid down in such a way that the channels are defined. Preferably the insert is already in position before the formation of the channel. In one arrangement a base slab of concrete is cast underneath and to one side of an insert and once the base slab has set a second layer of concrete is cast to the other side of the insert to complete the channel.

The insert may be any suitable elongate member such as an upwardly facing channel section beam or a simple right angle section beam. In preferred arrangements the insert supports the base and one or both vertical surfaces of a wall panel and acts as a foundation beam of the structure. An elongate insert may comprise a single elongate insert of a series of short inserts, although such may be difficult to align.

The inserts are preferably connected, e.g. by means of bolts or other suitable fasteners, to elements of the frame. For example, with a frame comprising vertical columns and horizontal beams, the inserts may be connected at their ends to the columns. In one arrangement the inserts lie in the vertical plane containing associated columns and in another arrangement the inserts lie slightly outside such plane.

The upper edges of the wall panels are preferably located by the frame, for example by beams extending between the columns above corresponding inserts. The wall panels may be secured to the beams e.g. by means of bolts. In a preferred arrangement the upper edges of the wall panels are received within downwardly facing channels formed in or by the beams. A preformed wall panel may have its upper edge engaged in a downwardly facing channel formed in or by a beam and its lower edge in an upwardly facing channel formed in the foundation and/or by an insert. Typically the downwardly facing channel will be formed by a beam of channel cross-section, e.g. an inverted "U".

The formation of walls between an upwardly facing channel formed in a foundation and a corresponding downwardly facing channel formed in a beam is advantageous in its own right and viewed from another aspect the present invention provides a building comprising a foundation, a load bearing frame comprising a plurality of interconnected beams and columns and wall panels, wherein the lower edge of each wall panel is received within an upwardly facing channel formed in said foundation and the upper edge of each wall panel is received within a downwardly facing channel formed in or by a said beam. Thus the opposing upwardly and downwardly facing channels locate the wall panels so that once the frame has been assembled the wall panels can be erected without requiring great skill.

In one arrangement a simple foundation comprises a concrete floor slab, preferably reinforced, which is supported around its periphery on a foundation beam and in the central region by earth filling. In another arrangement individual concrete foundation pads are cast in a stable building platform at the site of columns of the frame and a reinforced concrete foundation is then laid over the stable building platform and foundation pads. The stable building platform may include e.g. earth filling and/or a grid of shallow piles. A polythene sheet can separate the floor slab from the foundation beams or pads and earth filling or other building platform below it to reduce problems due to dampness.

To further avoid the risk of the building being affected by dampness, a sealant is preferably included between each wall panel and the foundation, preferably between the outer face of each panel and the foundation or an insert such as an angle iron. As a further precaution, the inner walls of the channels defined in the foundation may be higher than the outer walls so that the floor of the interior of the building is raised above the surrounding ground level. These features may also be new and inventive in their own right.

The foundation may have any floor covering above it, such as floor tiles or a carpet. A second slab or thin layer e.g. of concrete may be laid above the foundation or may comprise part of the foundation, and may be covered with any floor covering. A concrete floor may be left exposed. Channels may be formed either in a single slab or in a slab co-operating with a second slab or layer.

The load bearing frame may be a substantially rigid space frame formed of any suitably strong material, but is preferably formed of steel. Advantageously, an anti-corrosive coating is applied. Frame elements such as beams and columns may be secured together in situ into a free standing structure e.g. by means of bolts. The structure may comprise a single storey, or may have a plurality of stories in which case the frame can have successive vertical rows of beams and columns.

Frame members such as columns are preferably of hollow square or rectangular section or any other section having a high strength for a relatively low weight. Beams provided with a downward facing channel to receive the upper edge of a wall panel may be formed of a channel section. In a multistorey building, the wall panels in floors above the ground floor are preferably mounted between corresponding vertical rows of beams, the lower edge of each wall panel being received in an upwardly facing channel formed in one of said beams. Thus in one arrangement in a multistorey structure the beams have an 'I'-section with channels facing upwardly and downwardly.

Since the panels forming the walls need not carry any load other than their own weight, they can be formed of a wide range of materials to suit climatic and environmental conditions local to the structure and according to cost requirements and other factors. Local materials may be used. Examples of materials which might be used are concrete, glass, timber or brick panels and for the internal walls in particular, plaster board. Preferably the wall panels are prefabricated which simplifies the erection of the building and facilitates manufacture of the panels to a consistent quality. In a preferred arrangement the wall panels are preformed substantially of reinforced aerated concrete which is strong, lightweight, relatively inexpensive, fire resistant and has good sound and thermal insulation properties. Suitable reinforced aerated concrete wall panels are manufactured by Ytong International GmbH (tm).

The wall panels may form both outer and inside walls in a building. Outer and inside walls may be formed substantially of the same or different materials. The outer walls are advantageously coated with waterproof material and the inside walls may be coated with quick drying decorative coating. In one arrangement the external walls are internally faced with a layer of insulating material and plaster board. In such an arrangement the outer wall panels may be spaced slightly outwardly from the plane of elements of the frame having a vertical component so that for example any columns are located between the outer wall panels e.g. formed of Ytong (tm) cellular concrete and inner wall panels e.g. formed of plaster board.

The wall panels preferably have a standard height e.g. substantially equal to the height of one storey of a structure. Upper and lower edges which are received respectively in downwardly and upwardly facing channels are preferably either slotted into the channels or are slidably engaged therein.

Preferably the panels have a standard width or a standard range of widths and the structure is designed so that the spacing of columns is such as to accommodate between them a whole number of standard width panels. Preferably any non-square or rectangular panels also have a standard shape for fitting between frame elements.

Adjacent panels may be joined together in any convenient manner. In one embodiment adjacent panels are joined by a tongue and groove arrangement, a sealant or adhesive optionally being applied at all the joints. Each column or other frame element adjacent a panel may be provided with a collar which is adapted to engage with the adjacent panel(s), e.g. by a tongue and groove arrangement. Such collars can protect the frame elements and may also be desirable from aesthetic considerations in that the bare frame element will no longer be exposed. If desired, a decorative coating can be applied.

Preferably panels used in the construction of a building are provided in a plurality of standard designs, each of which may incorporate one or more features normally associated with walls. For example, in addition to 'plain' panels, one standard panel may include a window frame and window and others may incorporate door frames and doors, openings, ventilation ducts etc or a combination of these features. Some panels may incorporate components and/or access for electrical, plumbing and other systems. In an arrangement in which the external walls of the building comprise an outer wall panel faced internally with an insulating material and plaster board, electrical conduits and pipework can be run between the outer wall panels and the plaster board. Also, some panels may be adapted to co-operate with standard kitchen or bathroom units etc.

A panel of a standard height and width may be made up of a plurality of smaller panels e.g. a window panel and filler panels above, below and to the sides of the window. All of the smaller panels may be accommodated within a single standard sized panel frame.

In a preferred arrangement windows and doors are accommodated in window and door frames which are provided around their periphery with a groove for sliding engagement with panels of the required size above, below and to either side as necessary to make up the standard panel size. In panels which are adjacent columns, smaller panels e.g. above window and door openings can be supported by brackets e.g. of angled section mounted on the columns. This feature may also be novel and inventive in its own right.

Great flexibility in design is afforded at low cost and with great simplicity and ease of construction by providing a range of prefabricated modular wall panels of standard widths and incorporating standard features which can be assembled and finished with decorative coatings as desired.

Any suitable roof can be applied to a building constructed in accordance with the above. In one convenient arrangement, prefabricated roof panels or clay tiles are laid over lightweight roof trusses e.g. of hollow rectangular section, which trusses are secured to the frame e.g. by means of bolts. The roof panels are preferably formed of or coated with a corrosion resistant material e.g. galvanised plastic coated steel panels.

In one arrangement, fascia boards of any convenient material, such as timber or cement based materials, are secured to a building e.g. by bolting. A strip of sealant material can advantageously be employed between fascia boards and roof panels.

Preferably the arrangement is such that no component of the load bearing frame is exposed at any point in the building.

In one arrangement a layer of insulating material such as mineral wool is supported between roof trusses and an outer roof covering. For example, a layer of insulating material can be supported on a wire mesh stretched over the roof trusses.

A false ceiling can be suspended from the roof structure, or otherwise supported, and a material having sound or thermal insulating properties can advantageously be used.

In at least preferred embodiments, a building constructed in accordance with the above will have a good resistance to earthquakes, both because of the nature of the foundation and the strong but lightweight nature of the structure. Should any collapse occur, the risk of injury is reduced by the lightweight nature of the structure. Furthermore, resistance to lateral wind loading is good in at least preferred embodiments because the load is easily transferred from the wall panels to the frame.

The present invention extends to methods of constructing such buildings and viewed from another aspect the present invention provides a method of constructing a building comprising providing a foundation, securing to said foundation a load bearing frame, providing an elongate insert in said foundation having horizontally and vertically extending flanges and arranging wall panels between said foundation and said frame, the bottom of said wall panels being located by said rigid insert.

Viewed from another aspect the present invention provides a method of constructing a building comprising providing a foundation, securing to said foundation a load bearing frame comprising a plurality of interconnected beams and columns, forming an upwardly facing channel in said foundation and arranging wall panels between said foundation and said beams, the lower edge of each said wall panel being received in a said upwardly facing channel and the upper edge thereof being received in a said downwardly facing channel formed in or by a said beam.

This invention also extends to walled structures in general such as fences for example, and methods of their construction.

Embodiments of the invention will now be described, by way of example only, with reference to the accompanying drawings, wherein:

FIG. 4(*b*) is a sectional view from above through an alternative column and wall panels in a second embodiment;

FIG. 5(*b*) is a schematic view of part of the walled structure of FIG. 5(*a*) at a second, later stage of construction;

Figure 1:
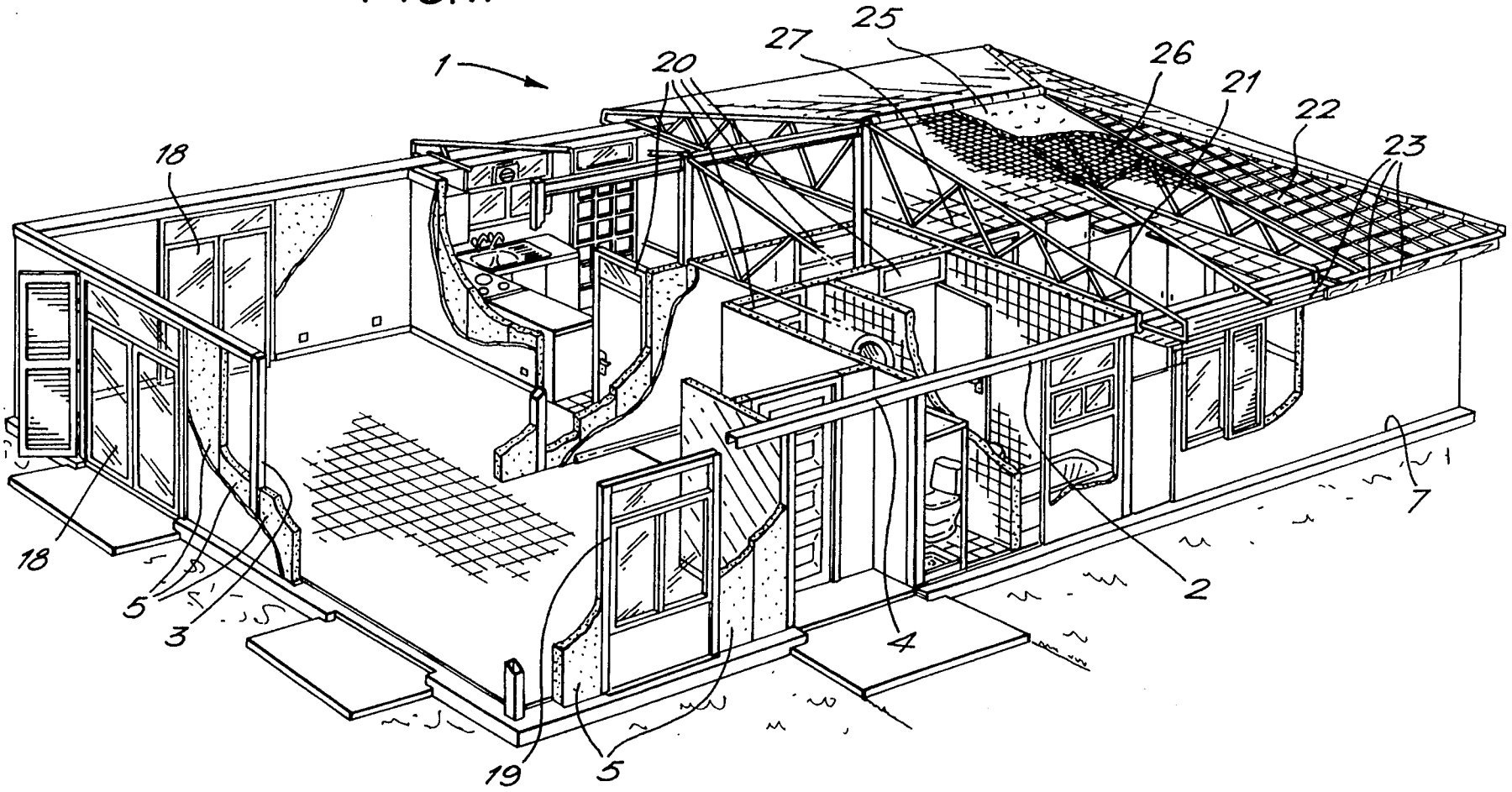
FIG. 1 is a perspective view of a building according to a first embodiment with some parts broken away.

There is illustrated in FIG. 1 a house 1 having a strong, rigid, free standing, load bearing steel frame 2 comprising vertical columns 3 and horizontal beams 4 which are bolted together. The columns 3 are of hollow rectangular section and the beams 4 are of an inverted channel section. The steel frame 2 is finished with an anti-corrosive coating. The frame is arranged to form the skeleton of the house, leaving open regions defining the rooms of the house.

The external and internal walls of the house 1 are made up of prefabricated panels 5. The panels 5 which form the external walls are made of Ytong (tm) pre-cast doubly reinforced aerated concrete, whereas the panels which form the internal walls are made of any locally used and acceptable material such as plaster board or Ytong (tm) aerated concrete. The panels are all of a standard height and of one or more standard widths, and are arranged to extend between the columns to form the outer walls of the house and to define rooms within the house.

Figure 2:
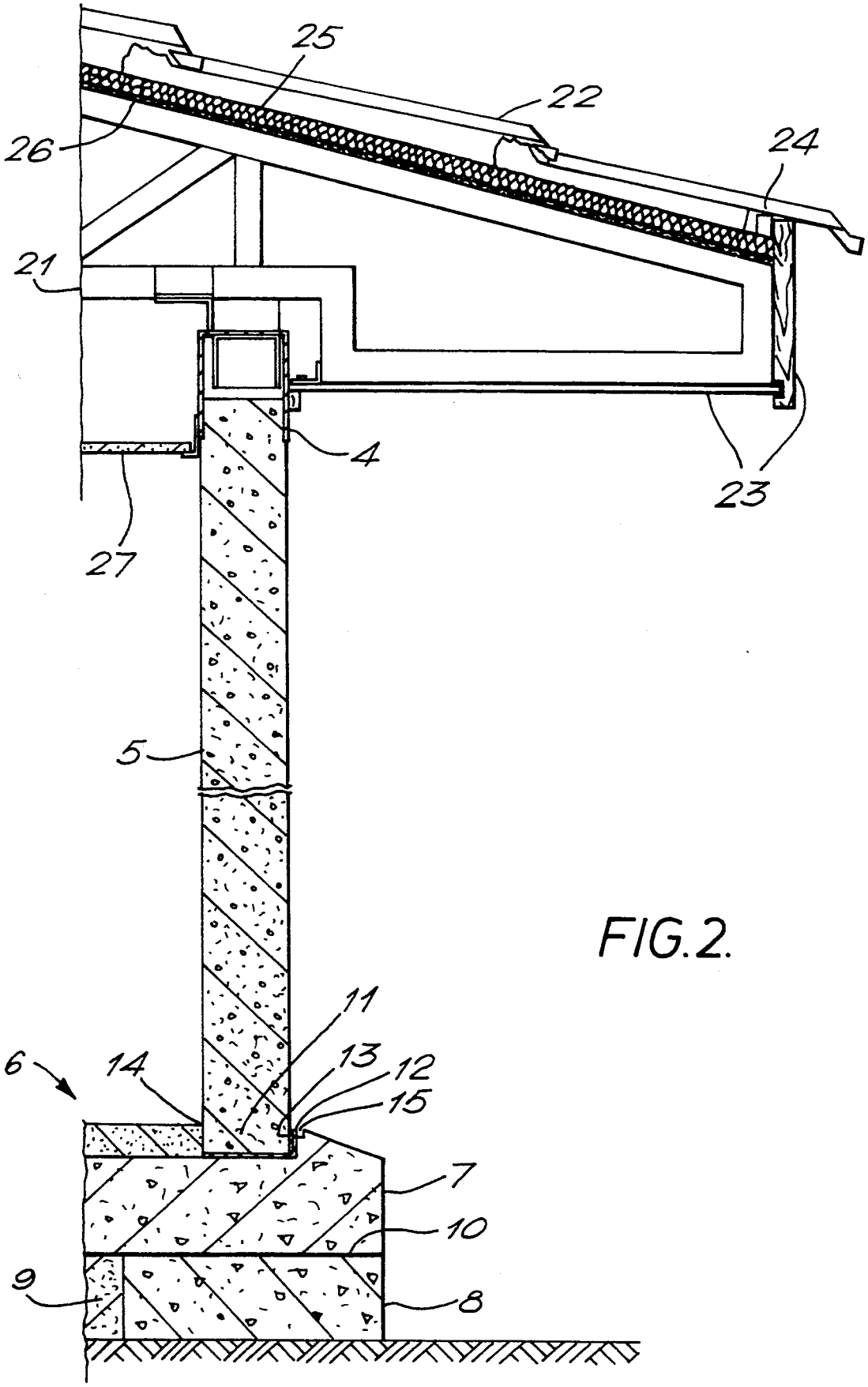
FIG. 2 is a sectional view through one outer wall of the building of FIG. 1.
Figure 3:
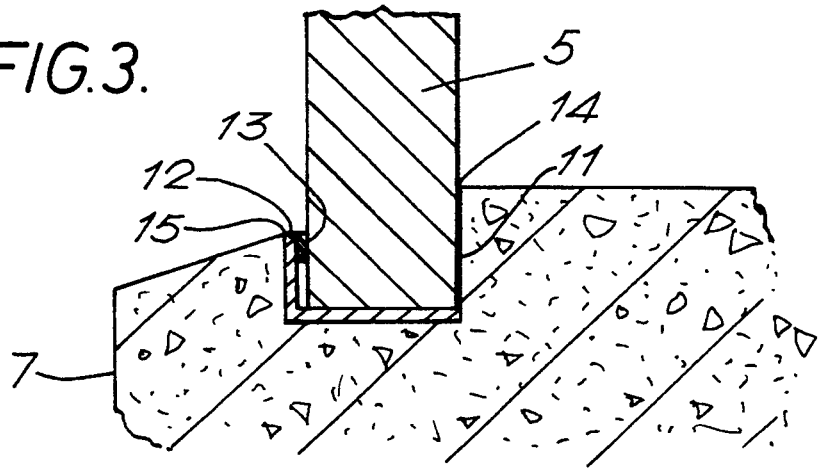
FIG. 3 is an enlarged detailed view of a part of the building of FIG. 1 showing the engagement of a lower edge of a panel with the foundation.

The house is built on a concrete foundation 6, illustrated in more detail in FIGS. 2 and 3. A reinforced concrete slab 7 rests on an outer foundation beam 8 and an inner region of earth filling 9. A polythene sheet 10 extends underneath the concrete slab 7 to prevent moisture rising up through the foundation. A channel 11 is defined in the foundation slab at the predetermined locations of the walls. As shown in FIG. 2, the concrete foundation slab in this embodiment comprises a lower slab extending under the wall panels, and a thinner layer of concrete inside the building which defines the inner wall of the channel. The lower edge of each panel 5 is received within the channel 11 and the upper edge of each panel 5 is received within the inverted channel section of beam 4. To assist in the location and support of the panels 5 a right angle section steel insert or angle iron 12 extends along the bottom and outer wall of the channel 11. A sealant strip 13 extends along the channel 11 between the outer face of the wall panel 5 and the angle iron 12 to prevent the ingress of moisture. As a further protection against dampness, the inner wall of the channel 14 is higher than the outer wall 15 so that the level of the floor inside the building is above the surrounding ground level.

Figure 4A:
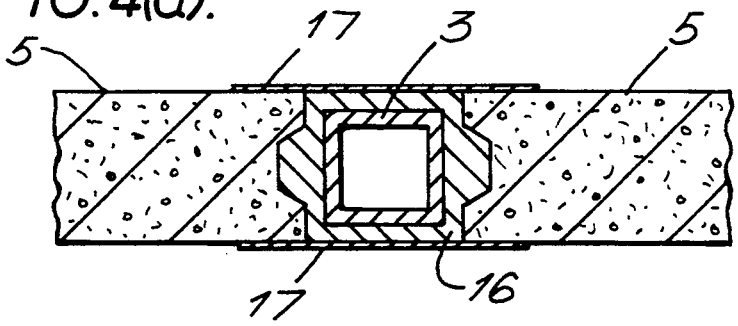
FIG. 4(*a*) is a sectional view from above through a column and wall panels in the first embodiment.
Figure 4B:
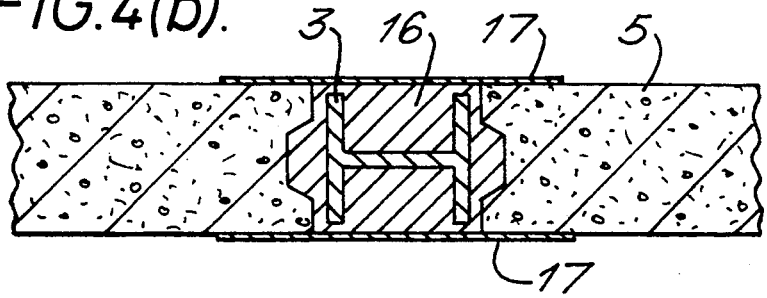

Adjacent panels 5 in the walls of the house engage with each other at tongue and groove joints, each panel being provided along one vertical edge with a 'tongue' and along the other vertical edge with a groove. At the joints between the columns and the panels there is engagement between tongues on collars 16 surrounding the columns and grooves formed on a vertical edge of each panel, as illustrated in FIG. 4. The collar 16 may be covered by a decorative strip 17. The tongue and groove joints may be glued.

FIG. 4(*b*) illustrates an alternative I - section column in another embodiment which is provided with a collar for making a tongue and groove joint with adjacent panels. Like parts are indicated by the same reference numerals in FIGS. 4(*a*) and (*b*).

Some of the panels 5 form plain sections of an outer or inner wall, whereas others include features such as a window or a door. Panels of the same design are in some cases repeated many times throughout the building. For example, there is illustrated in FIG. 1 a patio door panel 18, which is repeated at the side and the back of the house. The patio door panel 18 comprises a door frame, two sliding doors and a small window above the doors to make the panel up to the standard height equal to the height of one storey. The panel is encased in a panel frame which extends around its periphery, and which can be slotted or slidably engaged in the channels defined in the beam above the panel and the foundations below it, and which is formed along its vertical edges with tongues and grooves to engage with adjacent panels. The patio door frame 18 is of a standard width, for example equal to twice the width of the adjacent plain wall panels 5. The standard widths will be appropriate so that the spaces between adjacent columns can be filled with a whole number of panels.

As a further example, the illustrated house includes a window panel 19, which comprises within a peripheral panel frame a window frame, two opening windows, and above and below the window frame a filler panel. The window frame is grooved around its periphery for sliding engagement with the panel frame and filler panels. In the interior of the house, wall panels 20 include interior doors.

In the roof of the house, lightweight roof trusses 21 formed of anti-corrosion coated hollow section rectangular steel are bolted to the frame 2. The roof covering 22 comprises pre-formed hot dip galvanised steel plastic coated roof panels, which are pressed into the shape of traditional roof tiles and are bolted to the roof trusses. The plastic coating ensures that the covering is waterproof. Fascia boards 23 are formed of a painted cement based material. A sealant strip 24 extends underneath the roof covering adjacent the vertical fascia board 23.

Roof insulation is provided by an insulating material 25 such as mineral wool which is supported on a chicken wire mesh 26 stretched over the roof trusses. A false ceiling 27 is suspended from the roof trusses and the upper portion of frame 2. The false ceiling 27 comprises prefinished mineral fabric acoustic tiles suspended from the roof trusses with exposed plastic coated aluminium T sections.

The interior and exterior faces of the wall panels are coated with a decorative finish and the floor is tiled and carpeted. The exterior walls are also coated with a waterproof finish and may be insulated internally e.g. with a layer of rockwool insulating material and plaster board. The location of features such as electrical wiring, plumbing etc is preplanned and is designed into and built up with the house. Thus, for example some of the wall panels 5 may be preformed with the facility for accommodating electrical sockets and wiring, and waste or water pipes e.g. between aerated concrete and plaster board layers. The rooms and wall panels may also be designed to co-operate with certain standard internal features such as kitchen and bathroom equipment and kitchen and bedroom units.

A house such as that illustrated can be constructed very quickly. For example the steel frame, foundations, walls (including windows, doors,) and roof can be constructed in less than a week, for example in five days by three, four or five people. One method of achieving this is by the steps of where necessary preparing a stable building platform, erecting the steel frame, casting the foundation slab, assembling into place the tongued and grooved wall panels complete with windows etc, and finally securing the roof complete with insulation. This can be done in shifts, for example with three people assembling the frame, laying the foundation and securing the roof and five people assembling the walls, or alternatively four people performing the whole operation. The electrical systems, plumbing, interior and exterior decorative finishes, floor coverings and furniture can be added for example within another ten days, so that the house is habitable less than three weeks after construction was commenced.

It will thus be seen that the illustrated building can be designed very simply, quickly and cost effectively using standard elements. The elements can be preformed and easily transported to the intended site of the building. The building can be easily and quickly constructed with the minimum of skill and equipment, and on almost any terrain. The finished building is of aesthetically pleasing appearance, strong, and well adapted to cope with wind loading, earthquakes and the surrounding environmental and climatic conditions.

Figure 5A:
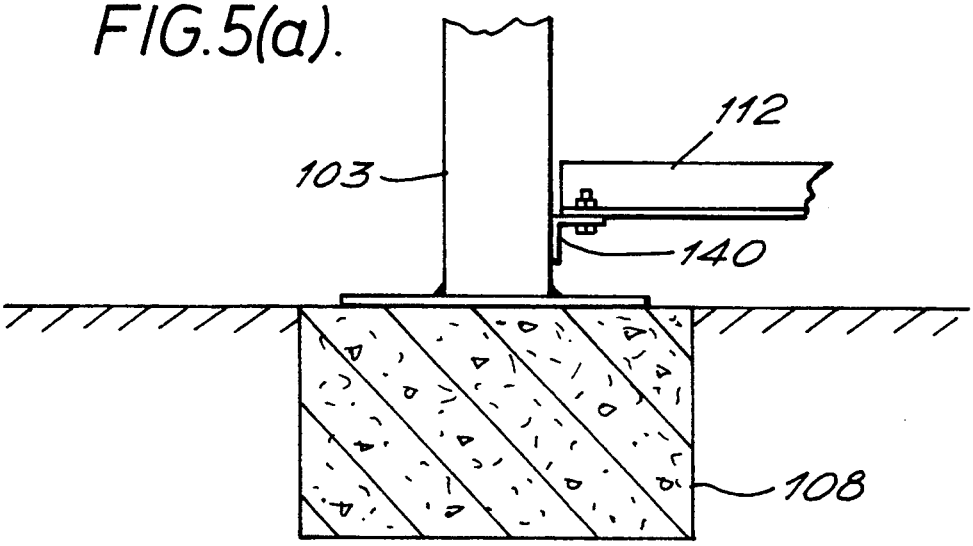
FIG. 5(*a*) is a schematic view of part of another walled structure at a first stage of construction.
Figure 5B:
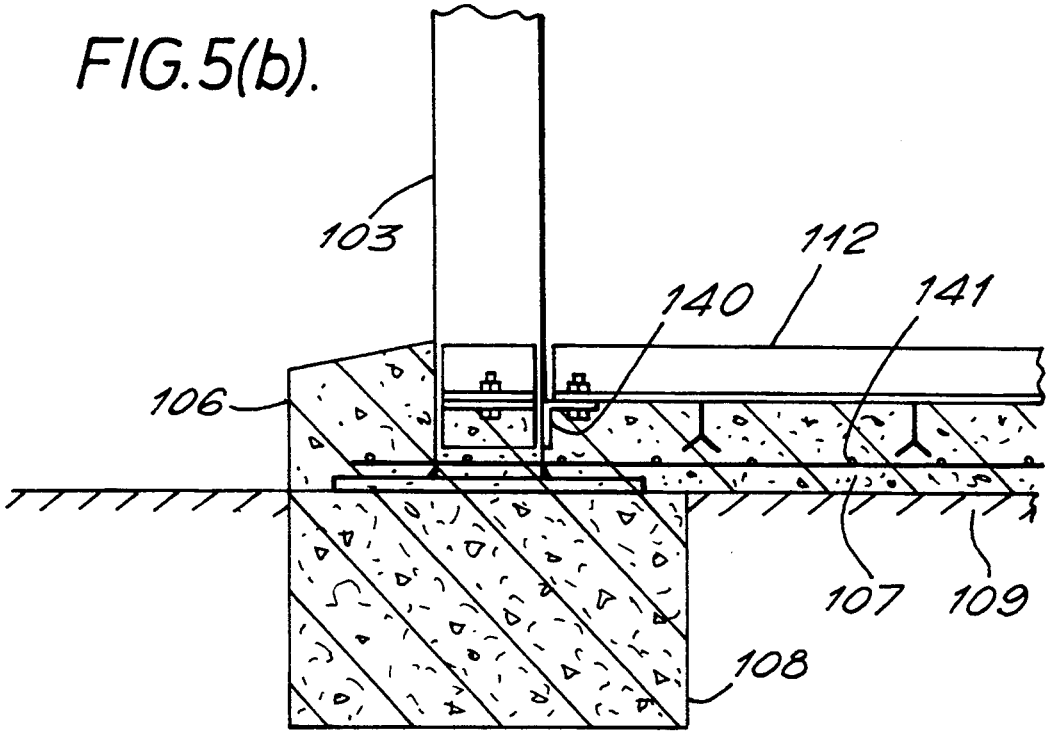

FIGS. 5 to 8 show schematic views of some alternative features of other embodiments. FIGS. 5(*a*) and (*b*) illustrated two stages in the formation of an alternative foundation 106 in which the columns 103 of the structure are supported on individual concrete foundation pads 108 rather than on a common concrete foundation beam. FIG. 5(*a*) shows a first stage in the construction in which the foundation pads have been cast and the substantially rigid load bearing frame has been assembled. Angle irons 112 are bolted at each end by means of brackets 140 to columns 103. At this stage in the construction drainage systems can be installed. The next stage of the construction of the foundation is shown in FIG. 5(*b*), wherein a polythene sheet has been laid over the ground 109 which has been treated as necessary to ensure a stable building platform, and a concrete foundation slab 107 having a steel reinforcing mesh 141 has been cast to a height just below the lower limb of the angle irons 112. The foundation slab 107 extends outwardly from the angle irons by a short distance and has a maximum height in this region substantially equal to the height of the vertical limb of the angle irons 112. The foundation slab 107 is sloped outwardly and downwardly in this region to direct surface water away from the interior of the structure. Finally, a further layer of concrete (not shown) will be cast in the interior of the structure on top of the existing foundation slab to complete the formation of an upwardly facing channel (not shown) around the angle irons 112. The final height of the foundation in the interior of the building will be at a level above the height of the vertical limb of the angle iron 112 so as to reduce the risk of water seeping into the interior of the structure.

Figure 6:
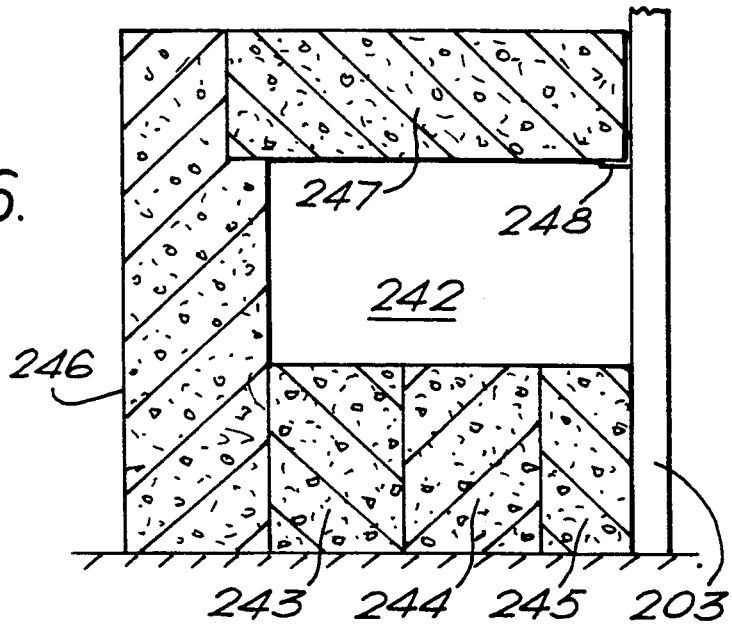
FIG. 6 is a schematic view of a partially assembled section of a wall of a structure.

FIG. 6 shows a partially assembled standard sized wall panel which will include a window frame (not shown) in the central aperture 242. The standard sized panel is made up of three panels 243, 244, 245 which will be located at their lower edges in upwardly facing channels reinforced with angle irons and will form tongue and groove joints at their upper edges with the window frame (not shown). A fourth panel 246 is of a standard height and its upper end will be received in a downwardly facing channel section beam. A fifth panel 247 above the aperture 242 engages along its upper edge in the inverted channel section beam and makes a tongue and groove joint with the window frame (not shown) at its lower edge. The panel 247 above the window frame is also supported by a right-angled bracket 248 mounted on the adjacent column 203 and by a step formed in the side panel 246. The gap between panels 246 and 247 is sealed with a repair mortar.

Figure 7:
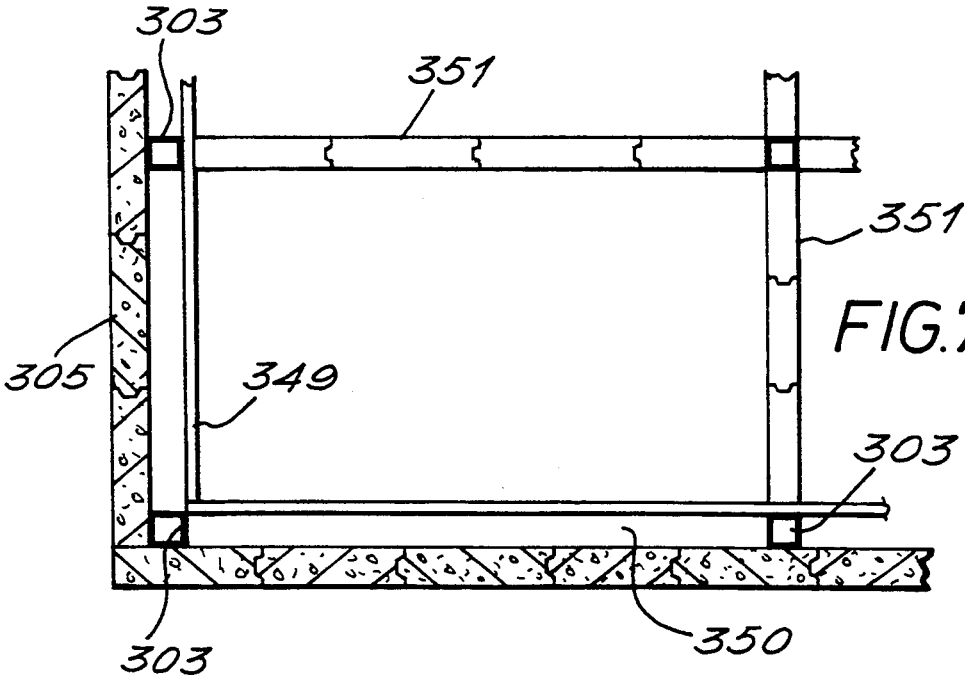
FIG. 7 is a schematic view from above of a section of the walls of a partially assembled structure.

FIG. 7 shows from above an arrangement of internal and external walls at one corner of a building. The external walls comprise Ytong (tm) aerated concrete panels 305 which are located at their lower ends by channels and inserts lying outside the plane of the columns 303. The external wall panels 305 are joined by tongue and groove joints sealed with an adhesive.

The external walls 305 are faced internally with plaster board 349 which lies in a plane inside the columns 303. The gap 350 between the external walls 305 and the plaster board 349 is filled with an insulating material (not shown) and can carry electrical conduits and pipework. The internal walls 351 in this embodiment are also formed of aerated concrete joined by tongue and groove joints.

Figure 8:
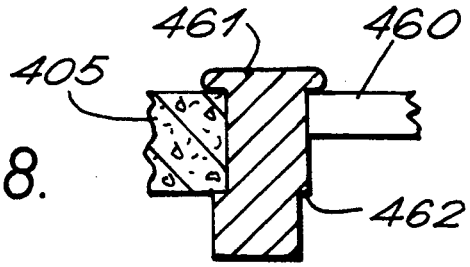
FIG. 8 is a cross-sectional view of a frame structure for use about a window (not shown).

FIG. 8 is a sectional view showing an arrangement for joining a window having an integral aluminium surround 460 to a wall panel 405. The window is provided with a window frame 461 formed in this embodiment of timber, which encompasses the integral window surround 460. Only one side of the window surround and window frame are shown. The wall panel 405 is received within a vertical channel formed in the window frame. The window surround is located by a stepped portion of the window frame and a further stepped portion 462 is provided on the outside of the window frame 461 for accommodating a shutter (not shown).

Various of the aspects and features which have been disclosed herein are novel and inventive and protection is or may be sought for all of the new and inventive features referred to.

I claim:

1. A building comprising a foundation base, a free standing substantially rigid load bearing frame including a plurality of substantially vertical columns supported on the foundation base and a plurality of substantially horizontal wall location lower beams having horizontally and vertically extending flanges connected between the lower ends of the columns, a foundation layer formed above said base and around the wall locating beams so as to define upwardly facing U-shaped channels with the wall locating lower beams positioned as elongate rigid inserts therein, and a plurality of wall panels arranged between the columns with their lower ends received within said upwardly facing channels and positioned by said elongate rigid inserts.

2. A building as claimed in claim 1, wherein the elongate inserts are right angle section beams.

3. A building as claimed in claim 1 or 2, wherein sealing means are provided between said inserts and said wall panels and the inner walls of said upwardly facing channels are higher than the outer walls.

4. A building as claimed in claim 1 or 2, wherein said load bearing frame is a space frame and said wall panels comprise preformed lightweight panels, substantially the entire structural load being carried by said frame.

5. A building as claimed in claim 1 or 2, including substantially horizontal upper beams with downwardly facing channels formed therein connected between said columns, and wherein the upper edges of said wall panels are received within said downwardly facing channels.

6. A building as claimed in claim 1 or 2, including collars surrounding said columns, and wherein each of said wall panels is preformed to a standard height and a standard width, said standard panels being made up of smaller panels including structural features of buildings such as windows and doors, tongue and groove joints being formed between adjacent panels and between panels and the collars surrounding said columns.

7. A building comprising a foundation base, a free standing substantially rigid load bearing frame including a plurality of substantially vertical columns supported on the foundation base and a plurality of substantially horizontal wall locating lower beams having horizontally and vertically extending flanges connected between the lower ends of the columns, a foundation layer formed above said base and around the wall locating beams so as to define upwardly facing U-shaped channels with the wall locating lower beams positioned as elongate rigid inserts therein, and a plurality of wall panels arranged between the columns with their lower ends received within said upwardly facing channels and positioned by said elongate rigid inserts; said elongate inserts comprising right angle section beams; sealing means provided between said inserts and said wall panels; the inner walls of said upwardly facing channels being higher than the outer walls; said load bearing frame comprising a space frame and said walls comprising preformed lightweight panels, substantially the entire structural load being carried by said frame.

8. A building as claimed in claim 7, including substantially horizontal upper beams with downwardly facing channels formed therein, and wherein the upper edges of said wall panels are received within said downwardly facing channels.

9. A building as claimed in claim 7, including collars surrounding said columns, and wherein each of said wall panels is preformed to a standard height and a standard width, said standard panels being made up of smaller panels including structural features of buildings such as windows and doors, tongue and groove joints being formed between adjacent panels and between panels and the collars surrounding said columns.

* * * * *